United States Patent [19]

Levko

[11] Patent Number: 4,949,063

[45] Date of Patent: Aug. 14, 1990

[54] END CLOSURE SYSTEM FOR HIGH SPEED FUSE

[75] Inventor: Fred Levko, Chesterfield, Mo.

[73] Assignee: Cooper Industries, Inc., Houston, Tex.

[21] Appl. No.: 344,717

[22] Filed: Apr. 24, 1989

[51] Int. Cl.[5] ..... H01H 85/14; H01H 85/16

[52] U.S. Cl. ..... 337/248; 337/252

[58] Field of Search ..... 337/248, 252, 253, 251, 337/254, 231, 232, 233, 236, 276, 205, 158, 159, 160; 174/52.3; 439/741, 870; 219/93

[56] References Cited

U.S. PATENT DOCUMENTS

| | | | |
|---|---|---|---|
| 973,250 | 10/1910 | Barricklow | 337/252 |
| 2,811,702 | 10/1957 | Narozny | 439/741 |
| 2,914,745 | 11/1959 | Krol et al. | 439/870 |
| 3,261,950 | 7/1966 | Kozacka | 337/251 |
| 3,301,978 | 1/1967 | Fister | 337/254 |
| 4,203,020 | 5/1980 | Ambruster et al. | 219/93 |

*Primary Examiner*—H. Broome

*Attorney, Agent, or Firm*—Donald J. Verplancken; David A. Rose; Ned L. Conley

[57] ABSTRACT

A high speed fuse 8 having terminals 14 staked to non-electrically conductive end bells 12 with fusible element 30 connected to ridges 44 on terminal 14 by projection welding, and round balls 18 plugging sand holes 20.

6 Claims, 2 Drawing Sheets

END CLOSURE SYSTEM FOR HIGH SPEED FUSE

BACKGROUND OF THE INVENTION

This invention relates in general to fuses and more particularly to high speed fuses.

High speed fuses have been used for a number of years for the protection or isolation of semiconductor devices such as diodes and thyristors. There is very little safety factor in these semiconductor devices and they can fail quickly when subjected to overcurrents. Therefore, a fuse designed to protect semiconductor devices must open quickly. High speed fuses have very little thermal capacity, and in general open in the order of 0.001 to 0.004 seconds when interrupting short circuits.

Problems exist with high speed fuses currently on the market because these fuses have been developed over time to meet specific applications, resulting in a large number of different fuses made in different sizes and shapes to satisfy the voltage and amperage ranges expected to be encountered. Several hundred different parts and subassemblies for these fuses may be be required. Thus, it would be desirable to be able to manufacture fuses having standardized parts to reduce the total number of parts that need to be stocked in order to manufacture a complete line of high speed fuses.

Prior art high speed fuses have an additional drawback in that the metal end bells which are mechanically and thus electrically connected to the mounting terminals are held to the insulating tube with metal pins which are exposed flush with the tube surface. Consequently, when in use in an electrical circuit the pins are at the same potential as the terminals and end bells. Typically, three phase electrical applications use a fuse in each phase mounted adjacent to each other and as close as possible to conserve space within the equipment. Industrial Standards govern minimum spacing between electrically hot parts. Since the pins are electrically hot and exposed to the tube surface, this prohibits the fuses from being mounted closer to one another.

Yet another difficulty is encountered in manufacturing high speed fuses in that the end bell must be joined to the terminal for mechanical strength of the fuse package and, in most designs, for the electrical connection between the current carrying fusible elements within the fuse and the mounting terminal. Prior art high speed fuses accomplished this by brazing, welding or soldering the terminal to the end bell or machining the end bell and terminal from a solid piece of metal or by pressing the metal pins through the tube and end bell and into the mounting terminal. All these techniques are labor intensive.

A further problem is encountered with end bells in that these circular pieces of metal are most often forged or machined from rod stock and coined, drilled, and sized. This again requires extra time and additional labor and is thus more expensive.

Yet another manufacturing problem is encountered in making high speed fuses. These fuses, in general, are filled with sand or other arc quenching materials. This material is added through a hole in the end bell after the end bell is assembled to the fuse tube. Various methods of plugging the hole have been used, but all suffer from various limitations.

SUMMARY OF THE INVENTION

The present invention employs stamped end bell and terminals rather than forged or machined parts. A slot for the terminal is punched through the end bell. The terminal is inserted into the slot in the end bell and staked in position. This insures a strong tight fit without requiring welding or soldering. In one embodiment the end bell is made of a non-electrically conductive material such as plastic. Round balls are used to seal the fill holes for the arc quenching material. One end of each terminal has coined ridges to facilitate automatic welding of the fuse link to the terminals.

DETAILED DESCRIPTION OF THE INVENTION

Figure 1A:
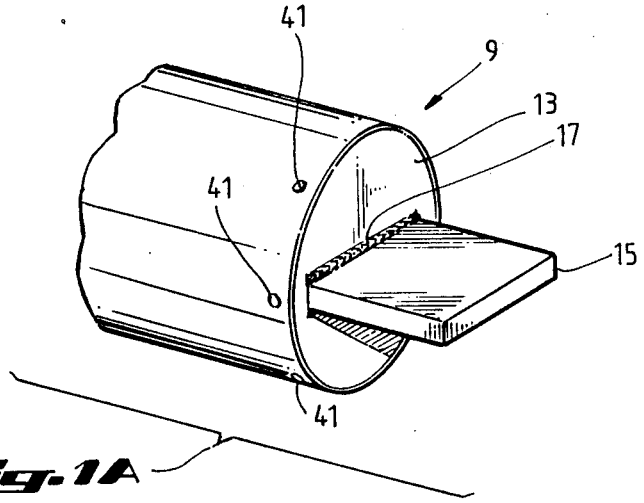
Fig. 1A (PRIOR ART)
FIG. 1A shows a perspective view partially cut away of a prior art fuse.

FIG. 1A shows a prior art high speed fuse 9. It is seen that the terminal 15 is welded 17 or brazed onto the metal end bell 13. Thus the end bell 13 is electrically hot when the fuse is mounted in an electrically energized circuit. The end bell is held in place by metal pins 41 which are also at the same voltage level as the end bell 13. Thus the minimum distance that prior art high speed fuses can be placed adjacent to each other, as dictated by industrial standards, is governed by the distance between the pins of adjacent fuses.

Figure 3:
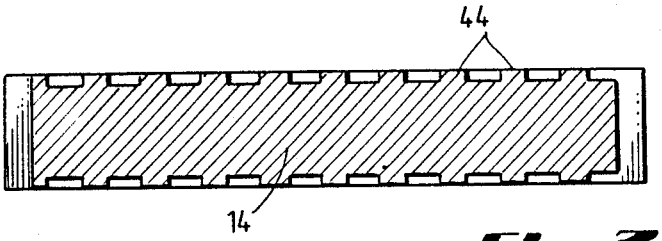
FIG. 3 shows a front view along the lines 3—3 of the terminal shown in FIG. 2.
Figure 4:
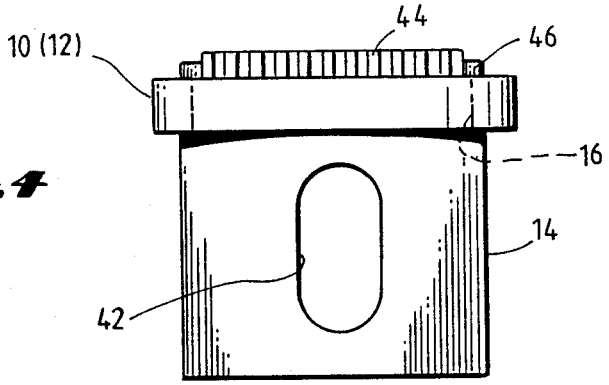
FIG. 4 shows a complete end bell assembly.
Figure 1B:
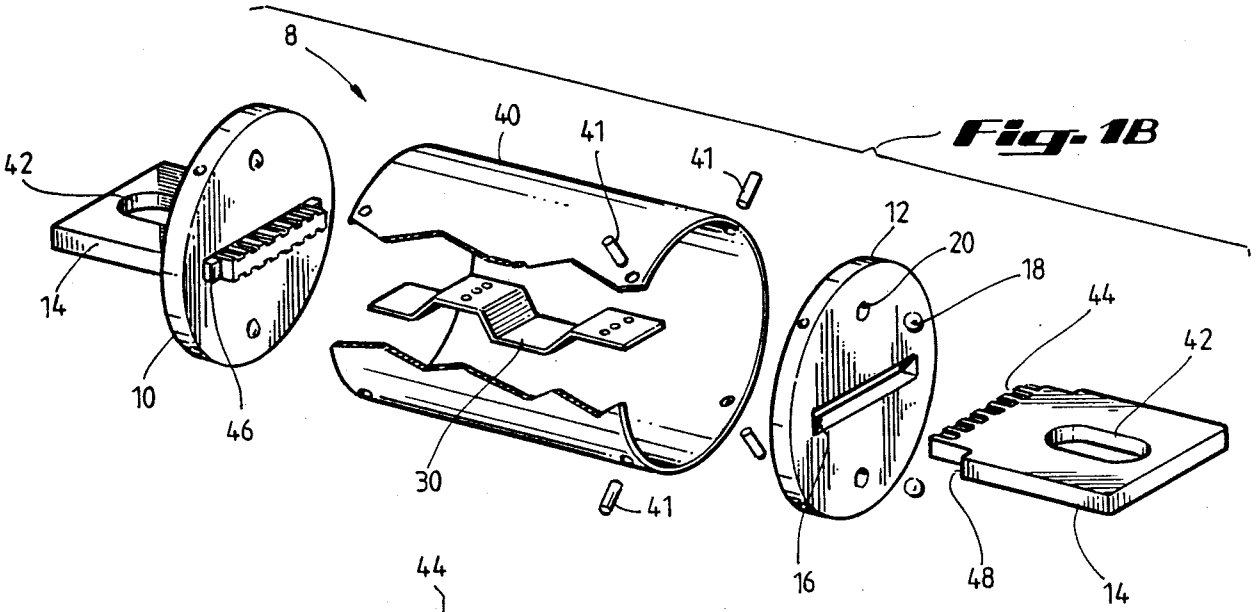
FIG. 1B shows a perspective view partially in section and exploded of a fuse according to the present invention.
Figure 2:
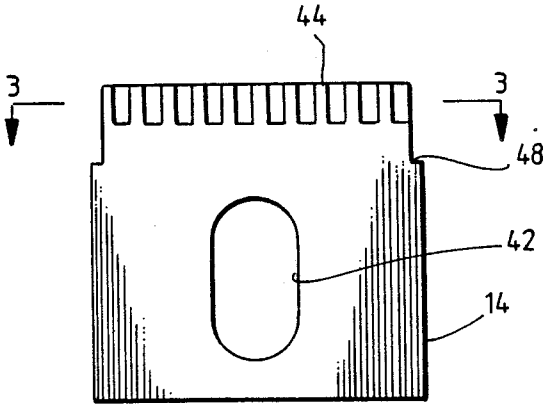
FIG. 2 shows a top view of a terminal of the fuse shown in FIG. 1B.

In the fuse according to the present invention shown in FIG. 1B and referred to generally by numeral 8 the end bell 12 is stamped from a piece of metal and a slot 16 is punched in the end bell 12. The terminal 14, which is also stamped from a piece of metal, has ridges or weld projections 44 on the end of the terminal 14 as shown in FIGS. 2 and 3. These ridges may be coined or machined into terminal 14. The terminal 14 is inserted into the slot 16 and staked 46 or coined or mechanically upset in position as shown in FIG. 4. Thus the terminal and the end bell are joined without brazing, welding or soldering, and without complicated mechanical assembly using additional components.

Since the terminal 14 projects through the front face and back face of the end bell 12 the fusible element 30 may be electrically connected directly to the terminal 14. Thus, the end bell 12 does not need to be made of electrically conducting material, and may be made of plastic or other non-electrically conductive materials.

An advantage of using plastic or other non-electrically conductive material for the end bell 12 is that it is less expensive than similar end bells made of metal. Also pins 41 designed to project through the insulating tube into the end bell are not energized since the end bell is not electrically conductive. Thus, when mounted in an electrical circuit, high speed fuses manufactured according to the present invention may be positioned closer to one another with the minimum distance between them governed by the electrically hot terminals and not by the pins.

An advantage to using ridges 44 on the terminal 14 is that it improves the welding of the fusible element 30 to the terminal. This type of construction is very useful for automating welding and results in a more consistent weld than that afforded by prior art spot welding techniques.

As the fuses are constructed, a first terminal is joined to an end bell, a second terminal is joined to an end bell, and a fusible element is welded between the two terminals. Because of the ridges 44 on the terminal 14 the welding of the fusible element may be done by projection welding.

Next, an insulating tube 40 is slipped over the end bell and connected to the end bells by pins 41, an arc quenching material, not shown for purposes of clarity, typically special sand, is poured into holes 20 in the end bell 12. After the high speed fuse 8 is filled with sand, the holes 20 are closed using a round ball 18. These round balls 18 may be steel or other material and are slightly larger than the hole in the end bell. Thus they are forced or pressed into the end bell 12. Using balls 18 has several advantages. They are self centering and are held in by frictional force. Alternately, the hole may be coined after insertion of the ball to hold the ball in. This is significantly easier than prior art processes which often used pins, hollow closed-end cylinders, or screws to seal the holes. The fusible element 30 is preferably of a standardized design using an accordion shape, which allows for the use of an element having a substantially longer overall effective length than can be achieved with a straight through element as in most prior art high speed fuses. The increase in effective length enhances the ability of the fuse to clear lower level overcurrent situations especially on DC circuits.

It is seen that high speed fuses manufactured according to the present invention are easier to construct, require less labor and are consequently less expensive to manufacture and, in one embodiment, can be used closer together, when mounted adjacent to one another, with reduced danger of shorting from fuse to fuse.

I claim:

1. A fuse comprising;

a first end bell assembly comprising;

a first end bell;

an opening in said first end bell;

a first terminal having one end of said first terminal inserted in and passing through said opening;

said one end of said first terminal having a portion projecting through said opening and said projecting portion being staked to said first end bell to secure said first terminal to said first end bell;

a second end bell assembly comprising;

a second end bell;

an opening in said second end bell;

a second terminal having one end of said second terminal inserted in and passing through said opening;

said one end of said second terminal having a portion projecting through said opening and said projecting portion being staked to said second end bell to secure said second terminal to said second end bell;

a fuse element having ends electrically and mechanically connected to said projecting portions of said first and second terminals;

arc quenching material surrounding said element; and a tube surrounding said arc quenching material.

2. A fuse having a fusing link therein, at least one terminal having a rectangular cross-section with one end adapter for connection to a conductive element and the other end adapted for connection to said fusing link, and at least one end bell the improvements therein comprising said end bell having a rectangular slot therethrough for receiving said rectangular cross-section terminal, said terminal having a portion thereof projecting through said slot and electrically conductively engaged with said fusing link, said portion having a substantially flat profile, said projecting portion of said terminal staked to said end bell to secure said terminal to said end bell.

3. A fuse as in claim 1 wherein said end bells and terminals are stamped from a sheet of metal.

4. A fuse as in claim 2 wherein said projecting portion includes a reduced width portion forming a shoulder, said projecting portion passing through said slot until said end bell engages said shoulder, said projecting portion having a weld projection on its terminal end, said weld projection being staked to said end bell and adapted for connection to the fusing link of the fuse.

5. A fuse as in claim 2 wherein said staking is the sole connection between said terminal and said end bell.

6. A fuse as in claim 2 wherein said end bell and terminal are stamped from a sheet of metal.

* * * * *

UNITED STATES PATENT AND TRADEMARK OFFICE

CERTIFICATE OF CORRECTION

PATENT NO. : 4,949,063

DATED : AUGUST 14, 1990

INVENTOR(S) : FRED LEVKO

It is certified that error appears in the above-identified patent and that said Letters Patent is hereby corrected as shown:

In column 4, line 24, after "end", delete "adapter" and insert -- adapted --.

Signed and Sealed this

Thirtieth Day of July, 1991

*Attest:*

*Attesting Officer*

HARRY F. MANBECK, JR.

*Commissioner of Patents and Trademarks*